US006435749B1

(12) United States Patent
Lecce

(10) Patent No.: US 6,435,749 B1
(45) Date of Patent: Aug. 20, 2002

(54) WEARABLE PEN-HOLDER DEVICE

(75) Inventor: Giovanni Lecce, Settimo Torinese (IT)

(73) Assignee: Quadrinvest S.p.A., Turin (IT)

( * ) Notice: Subject to any disclaimer, the term of this patent is extended or adjusted under 35 U.S.C. 154(b) by 0 days.

(21) Appl. No.: 09/889,735

(22) PCT Filed: Nov. 22, 2000

(86) PCT No.: PCT/EP00/11602

§ 371 (c)(1),
(2), (4) Date: Jul. 20, 2001

(87) PCT Pub. No.: WO01/38104

PCT Pub. Date: May 31, 2001

(30) Foreign Application Priority Data

Nov. 23, 1999 (IT) ..... T0990208 U

(51) Int. Cl.[7] ..... B43K 23/02

(52) U.S. Cl. ..... 401/131; 401/88; 24/10 R; 24/11 PP

(58) Field of Search ..... 401/52, 88, 92–94, 401/98, 131, 195; 24/10 R, 11 R, 11 PP, 11 CC, 3.11–3.13; 211/69.5

(56) References Cited

U.S. PATENT DOCUMENTS

| | | | | | |
|---|---|---|---|---|---|
| 1,377,097 | A | * | 5/1921 | Seaton | 401/88 |
| 1,647,536 | A | * | 11/1927 | Miller | 401/88 |
| 4,674,298 | A | | 6/1987 | Wimmershoff-Caplan | |
| 5,140,723 | A | | 8/1992 | Genzel | |
| 5,259,095 | A | | 11/1993 | Tam | |

* cited by examiner

*Primary Examiner*—Gregory Huson
*Assistant Examiner*—Tuan Nguyen
(74) *Attorney, Agent, or Firm*—Sughrue Mion, PLLC

(57) ABSTRACT

The pen-holder device includes a body (10) with at least one cavity (14) formed therein with at least one aperture (16) communicating with the exterior and with at least one resilient member (22) fixed to an inner wall of the said cavity (14) so as to be able to engage a tip (34) of a writing instrument (36) inserted therein. The body (10) also has means for securing it to a user, or to an accessory or garment worn by the said user. The cavity (14) is preferably frusto-conical, tapering towards the inside of the body (10).

6 Claims, 2 Drawing Sheets

WEARABLE PEN-HOLDER DEVICE

BACKGROUND INVENTION

The present invention relates to a penholder device. In the following description, the term "pen" should be understood in its broadest sense and to include writing instruments in general, that is also pencils, brush pens, propelling pencils and the like.

SUMMARY OF THE INVENTION

The object of the present invention is to provide a pen-holder device that can be worn and can be adapted to hold writing instruments of different sizes.

This object is achieved according to the invention by providing a pen-holder device which includes a body with at least one cavity communicating with the exterior and a resilient member fixed to the inner wall thereof in such a way that one end of a writing instrument inserted into the cavity may be engaged in the said cavity, the said body also having means enabling it to be secured to a user, or to an item of clothing or an accessory worn by a user.

According to the invention, the end of the writing implement which is inserted into the cavity deforms the resilient member which exerts a reactive and/or frictional force, thereby retaining the writing instrument. The degree to which the resilient member is deformed depends on the shape and dimensions of the writing instrument, ensuring that it is held within the cavity.

The device of the invention may thus be described as universal with regard to its characteristic ability to adapt to writing instruments of different shapes and sizes.

BRIEF DESCRIPTION OF THE DRAWINGS

Further advantages and characteristics of the present invention will become apparent from the detailed description which follows, with reference to the appended drawings, provided purely by way of non-limitative example, in which.

DETAILED DESCRIPTION OF THE INVENTION

Figure 1:
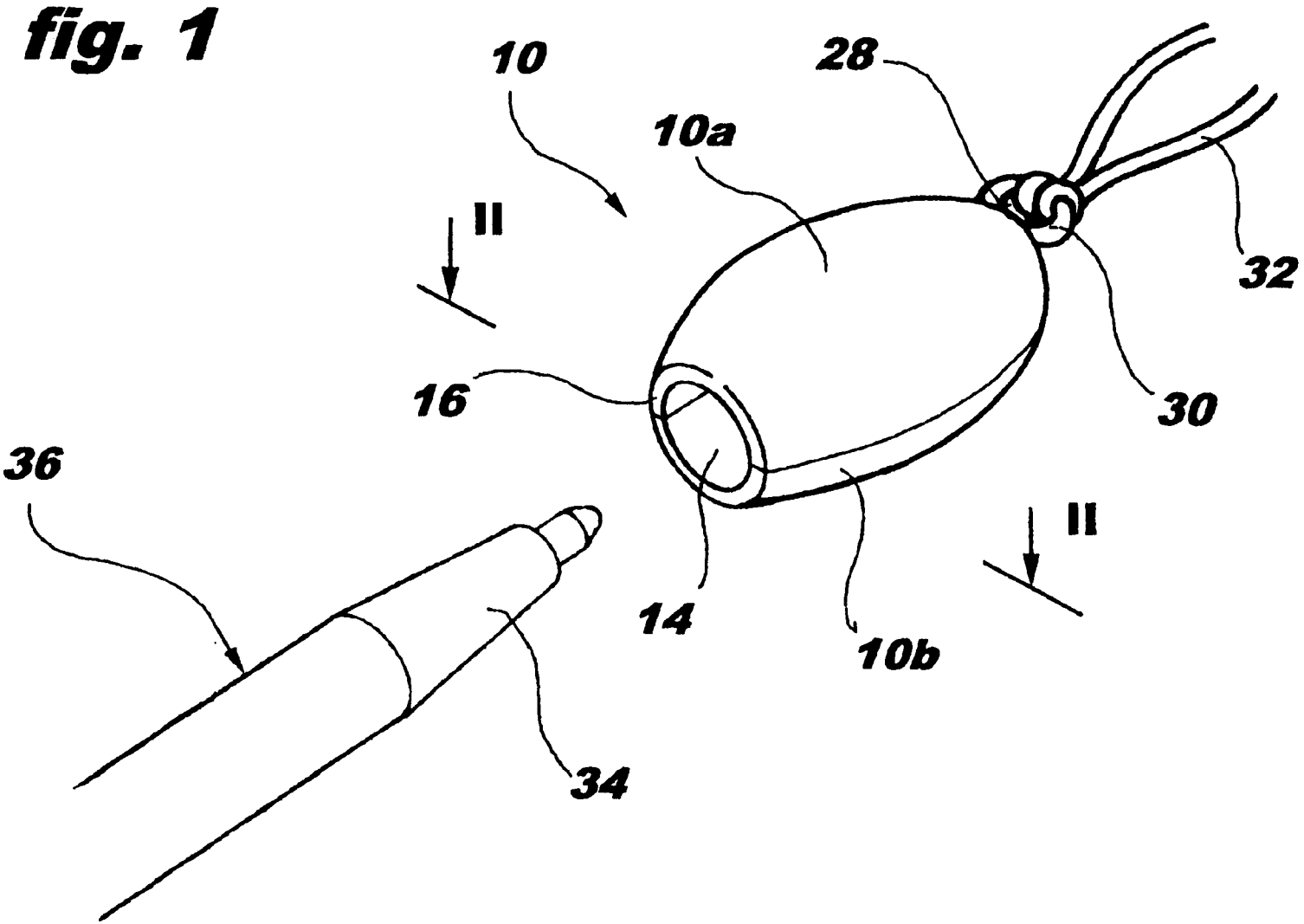
FIG. 1 is a perspective view of a device according to the invention and of a writing instrument for insertion therein.

A pen-holder device comprises a substantially ellipsoid body 10, made up of two half-shells 10*a*, 10*b*, of plastics material, for example, coupled through a centre plane 12 substantially parallel to the overall plane of the ellipsoid. The half-shells are coupled in a conventional manner which is substantially transparent in the context of the invention and thus not described in greater detail.

A cavity 14 is formed within the body 10 with an opening 16 communicating with the exterior and extending along the longest axis 18 of the ellipsoid. The cavity 14 is substantially frusto-conical, tapering towards the inside of the body 10.

A first and a second resilient member 22 are housed in recesses 20 facing each other along the internal wall of the cavity 14, so as to protrude into the span of the said cavity.

The resilient members 22—made of a polymeric or metal material for example—are strips with a Greek-fret shape and have respective tabs 24 on the ends for insertion into seats 26 in the body 10.

The latter also has means enabling it to be secured to a user, or to an accessory of item of clothing worn by this user. These means include a through hole 28 formed in an appendage 30 of the body 10 and a thread 32 which passes through the hole 28 and can be tied like a necklace, for example, around the user's neck.

The appendage 30 extends from the body 10 substantially at an end of the longest axis 18 of the ellipsoid, opposite the end where the cavity 14 opens into a mouth 16.

Figure 3:
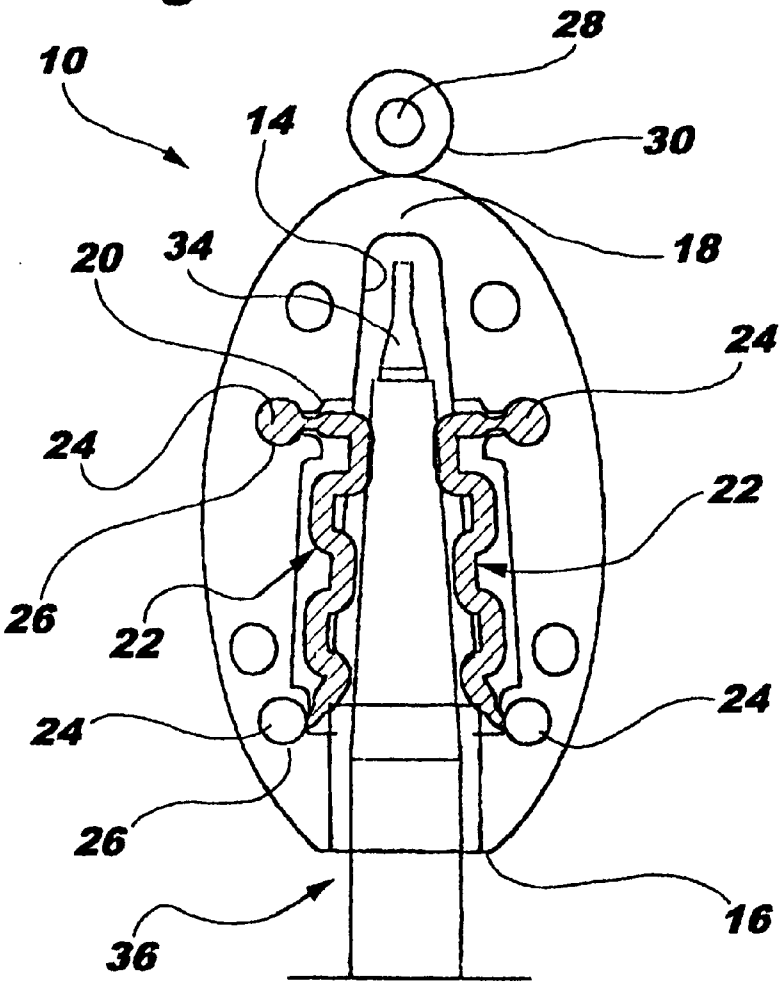
FIG. 3 is a similar view to that of FIG. 2, with a second writing instrument inserted in the device of the invention.
Figure 2:
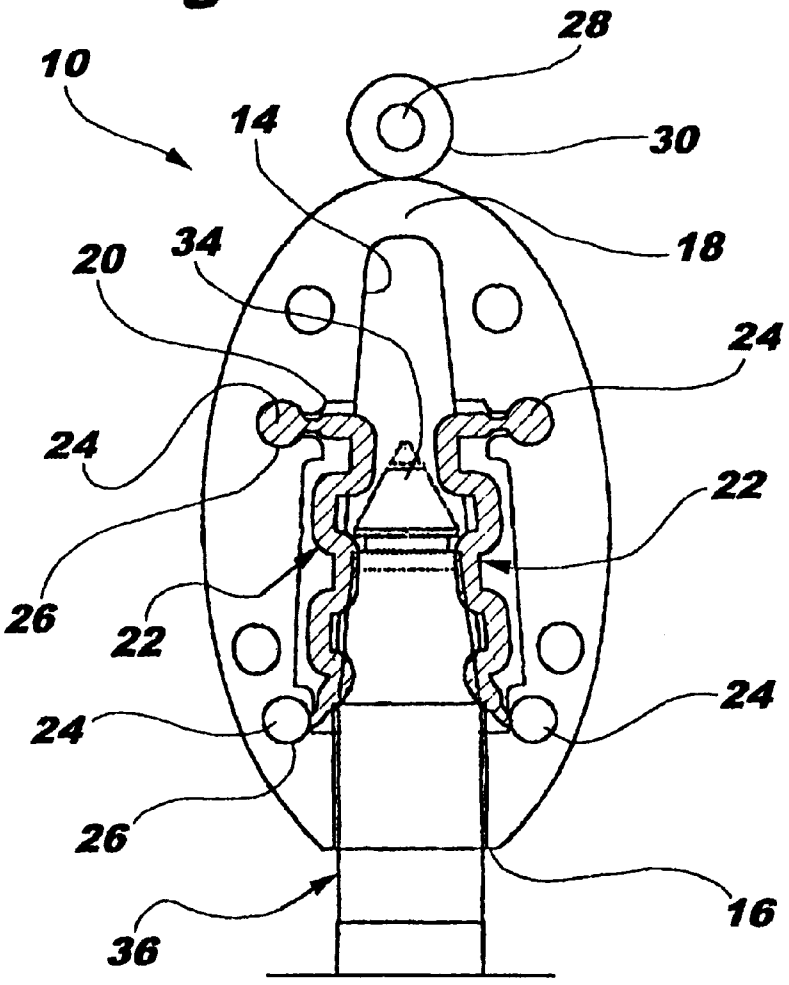
FIG. 2 is a plan view, with a section taken on the line II—II of FIG. 1, of the device of the invention with a first writing instrument inserted therein.

When one end 34, the point for example, of a writing instrument 36 is inserted into the cavity 14, the resilient members 22 are deformed and exert a reactive and/or frictional force retaining the point 34, provided, naturally, that the dimensions of the latter enable it to interfere with the resilient members 22 in their rest configuration thereby at least partially deforming them. As can be seen from a comparison of FIGS. 2 and 3, in dependence on its dimensions, the point 34 enters more or less deeply into the cavity 14, meaning that, accordingly, various portions of the members 22 are more or less deformed or pressed into the walls of the cavity 14. The resilient members 22 are able, in each case, to exert pressure, or simply friction, on the point 34, thereby preventing the writing instrument 36 from slipping out of the cavity 14, even when the latter is positioned vertically, with the opening 16 facing down.

The effects of the present invention naturally extend to other articles using the same innovative concept to achieve the same purpose. In particular, it is clear that the body may be of substantially any shape, and the resilient members may be any number and of any shape, provided they are operable to exert a sufficient retaining force on writing implements of various dimensions. The means enabling the device of the invention to be secured to a user could also be different from those described above: they could, for example, consist of a clip or clasp of a type commonly used to secure a pen to the edge of a pocket of a garment.

It is also conceivable that several cavities of the type described above could be formed in the body of the device, so that it could be used to carry several writing implements at the same time.

What is claimed is:

1. A pen-holder device comprising a body (10) having at least one cavity (14) formed therein, with at least one opening (16) communicating with the exterior and with a first and a second resilient members (22) housed in respective recesses (20) facing each other along an internal wall of the cavity (14), said resilient members protrude into the span of the cavity (14) so that they can engage a tip (34) of a writing instrument (36) inserted into said cavity (14), said body (10) also having means for enabling it to be secured to a user, or to an accessory of garment worn by the said user, wherein said resilient members (22) are strips with a Greek-fret shape and having respective tabs (24) on one end of each strip for insertion into seats (26) formed in said body (10).

2. A device according to claim 1, in which said cavity (14) is substantially frusto-conical, tapering towards the interior of the body (10).

3. A device according to claim 1, in which said body (10) is substantially ellipsoid, with said cavity (14) extending along the longest axis (18) of the ellipsoid.

4. A device according to claim 1, in which said body (10) is formed by two half-shells (10*a*, 10*b*) coupled at a center plane (12) substantially parallel to the overall plane of the body (10).

5. A device according to claim 1, in which said means for enabling the body (10) to be secured to a user include a through hole (28) in an appendage (30) of said body (10) and a thread (32) passing through said hole (28) and is adapted to be tied in the manner of a necklace.

6. A device according to claim 5, in which said appendage (30) extends from the substantially ellipsoid body (10) at one end of the longest axis (18) thereof, at the opposite end of said axis (18) is the opening (16) of the cavity (14).

* * * * *